US012644340B2

(12) United States Patent
Pai et al.

(10) Patent No.: US 12,644,340 B2
(45) Date of Patent: Jun. 2, 2026

(54) COOLING OF ELECTROCRUSHING DRILL ASSEMBLY

(71) Applicant: Halliburton Energy Services, Inc., Houston, TX (US)

(72) Inventors: Nagaraja K. Pai, Lancaster, PA (US); Boguslaw Wiecek, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/214,222

(22) Filed: May 21, 2025

(65) Prior Publication Data

US 2026/0063002 A1 Mar. 5, 2026

Related U.S. Application Data

(60) Provisional application No. 63/690,151, filed on Sep. 3, 2024.

(51) Int. Cl.
*E21B 7/15* (2006.01)
*E21B 36/00* (2006.01)

(52) U.S. Cl.
CPC ..... *E21B 7/15* (2013.01); *E21B 36/001* (2013.01)

(58) Field of Classification Search
CPC ..... E21B 7/14; E21B 7/15; E21B 36/001
See application file for complete search history.

(56) References Cited

U.S. PATENT DOCUMENTS 12,331,641 B2 * 6/2025 Pai ..... E21B 17/003
2013/0032400 A1 * 2/2013 Dirksen ..... E21B 36/001 175/17
2014/0116071 A1 * 5/2014 Jung ..... E21B 47/0175 62/260
2015/0042145 A1 2/2015 Grotendorst
(Continued)

FOREIGN PATENT DOCUMENTS

WO 2022155743 A1 7/2022

OTHER PUBLICATIONS

International Patent Application No. PCT/US2025/030311, International Search Report and Written Opinion mailed Sep. 9, 2025, 11 pages.

*Primary Examiner* — David Carroll
(74) *Attorney, Agent, or Firm* — Kilpatrick Townsend & Stockton LLP

(57) ABSTRACT

An electrocrushing drilling apparatus may include a downhole electrocrushing drill assembly that is part of a bottomhole assembly coupled to a downhole end of a coiled tubing drill string. The coiled tubing drill string can be deployed into a wellbore of a hydrocarbon well to advance the wellbore by way of an electrocrushing drilling operation whereby formation rock is fractured by high voltage electrical energy pulses emitted by electrodes of a drill bit of the electrocrushing drill assembly. Potential damage to electronic or other components of the bottomhole assembly due to excess heat generated by power losses of electrocrushing drill assembly can be minimized or prevented by actively cooling the electronic or other components of the bottomhole assembly using a liquid coolant that is conveyed from an earth surface of the well downhole to the bottomhole assembly and passed through the electronic or other components of the bottomhole assembly.

20 Claims, 7 Drawing Sheets

(56) References Cited

U.S. PATENT DOCUMENTS

| | | | | |
|---|---|---|---|---|
| 2016/0017663 | A1* | 1/2016 | Moeny | E21B 17/003 175/327 |
| 2017/0152744 | A1* | 6/2017 | Mladjan | E21C 41/16 |
| 2017/0362490 | A1 | 12/2017 | Van Slyke et al. | |
| 2018/0148981 | A1* | 5/2018 | Moeny | E21B 17/003 |
| 2022/0384105 | A1* | 12/2022 | Wiecek | E21B 7/15 |
| 2023/0184043 | A1 | 6/2023 | Hay | |
| 2025/0034946 | A1 | 1/2025 | Pai et al. | |

* cited by examiner

COOLING OF ELECTROCRUSHING DRILL ASSEMBLY

CROSS-REFERENCE TO RELATED APPLICATIONS

This application claims the benefit of U.S. Provisional Application 63/690,151, filed Sep. 3, 2024, and titled COOLING OF PULSED POWER DRILL ASSEMBLY, the entirety of which is incorporated herein by reference.

TECHNICAL FIELD

The present disclosure relates generally to pulsed power drill assemblies and, more particularly (although not necessarily exclusively), to systems and techniques to cool electrocrushing drill assemblies using liquid coolants.

BACKGROUND

A wellbore can be formed in a subterranean formation for extracting produced hydrocarbons or other suitable materials. One or more techniques may be used to drill the wellbore in the subterranean formation. In one example, a wellbore may be drilled using an electrocrushing drilling technique that employs pulsed power technology. Pulsed power technology repeatedly applies a high electric potential across electrodes of an electrocrushing drill bit. The high electric potential pulses contact surrounding rock in the wellbore and ultimately cause the rock to fracture. As the electrocrushing drill bit advances downhole, the fractured rock can be carried away from the electrocrushing drill assembly and uphole in the wellbore by drilling fluid that is expelled from the electrocrushing drill bit. The amount of electrical energy dissipated by an electrocrushing drill assembly during an electrocrushing drilling operation can be significant and may result in a buildup of excess heat in the wellbore. This excess heat may be passed to other electronic components associated with a bottomhole assembly of which the electrocrushing drilling assembly may be a part.

DETAILED DESCRIPTION

Figure 1:
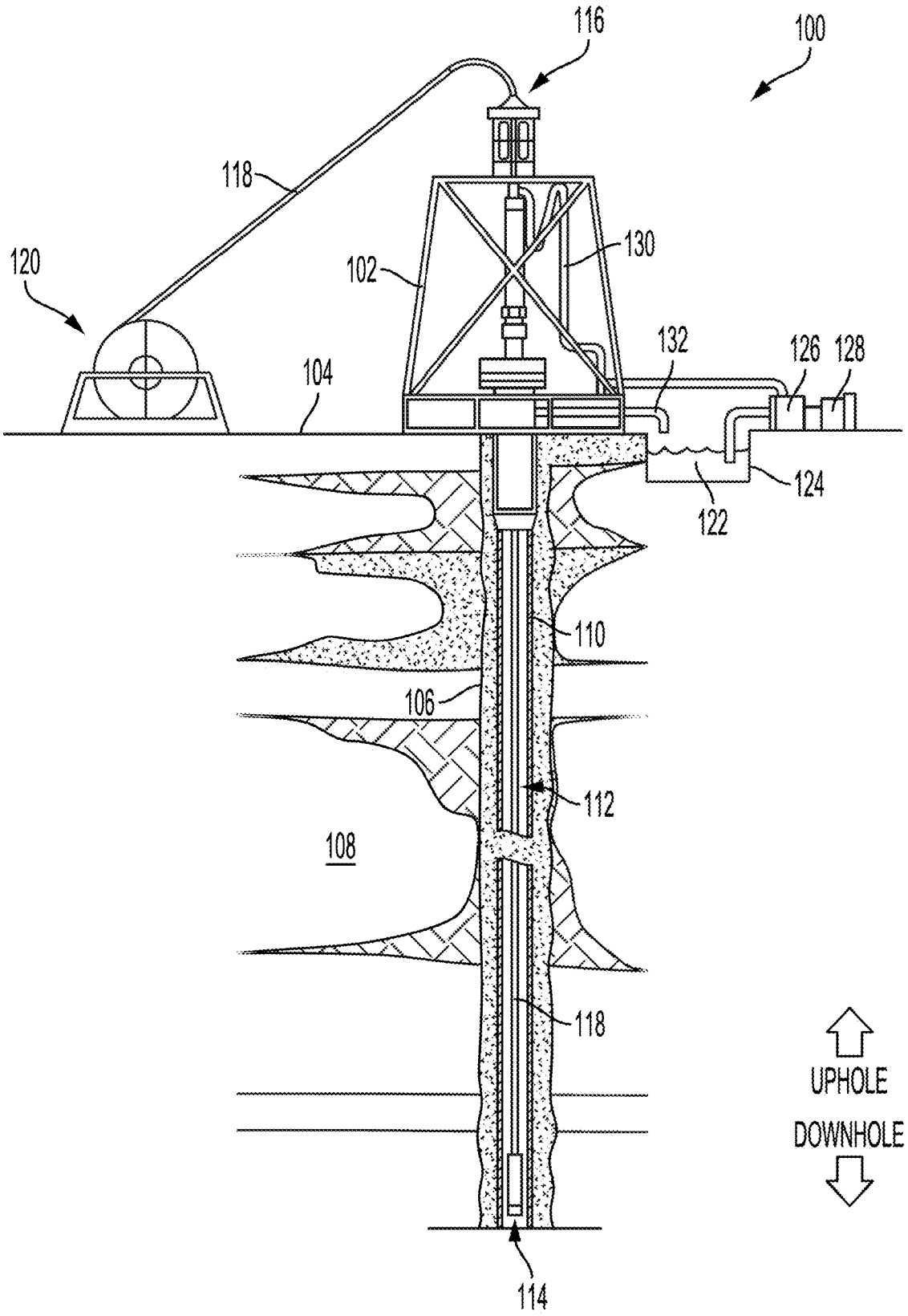
FIG. 1 is a schematic diagram illustrating an electrocrushing drilling operation of a hydrocarbon well according to one example of the present disclosure.

Certain aspects and examples of the present disclosure relate to systems and electrocrushing drilling apparatus that can utilize liquid coolants to actively cool components of a downhole electrocrushing drill assembly portion of the electrocrushing drilling apparatus operating in a downhole environment. In some examples, the electrocrushing drill assembly may be used in an electrocrushing drilling operation to form a wellbore in a subterranean formation. The wellbore may be a wellbore of a hydrocarbon well. During operation of an electrocrushing drilling apparatus of which the electrocrushing drill assembly is a part, high voltage electrical energy supplied to a drill bit of the electrocrushing drill assembly can produce a high electric potential between electrodes of the drill bit. This can cause surrounding rock in the wellbore to fracture as described in more detail below. Fractured rock pieces can be carried away from the electrocrushing drill bit by drilling fluid that is supplied to the electrocrushing drill assembly and expelled through electrocrushing drill bit.

At least some electronic and other components of the electrocrushing drill assembly may be a part of a bottomhole assembly (BHA) of a downhole drill string. Various components of the electrocrushing drill assembly may exhibit substantial power losses during a drilling operation. For example, the magnitude of the power losses experienced by components of an electrocrushing drill assembly may be hundreds of kilowatts. Such power losses may be several orders of magnitude greater than the power losses exhibited by the electronic components of many typical drilling systems or measurement while drilling systems, where total power losses in the electronics area may be limited to a few watts. Even in downhole assemblies having rotating components such as motors, total power losses may be no more than hundreds of watts. Thus, an electrocrushing drill assembly can exhibit power losses that are far beyond those associated with typical downhole drilling, measuring, or logging equipment. Additionally, at least some electrocrushing drill assembly components may experience high peak power losses where megawatts of power may be lost in only a few milliseconds or a few microseconds, followed by no or limited power losses for a longer period of time. Thus, an electrocrushing drill assembly may exhibit patterns of both high average power loss and high intermittent power loss.

The power losses of an electrocrushing drill assembly can result in the generation of heat and a resulting heating of the subassemblies and components of the BHA. Due to the magnitude of the power losses, the amount of heat generated can be substantial, and can detrimentally affect various downhole subassemblies or components of the electrocrushing drill assembly or other subassemblies or components of the BHA. For example, excessive heat may be particularly harmful to electronic components such as semiconductor devices or transformers. It is thus desirable to reduce the amount of heat to which such downhole subassemblies or components are exposed as a result of operating an electrocrushing drill assembly. However, in downhole environments there may be no or very limited natural cooling because the ambient itself may be at very high temperature. Likewise, while drilling fluid can be pumped downhole to an operating area of an electrocrushing drill assembly, drilling fluid is typically not an effective heat transfer medium, especially considering the large amounts of heat that may be generated by an electrocrushing drill assembly.

According to examples of the present disclosure, the amount of heating experienced by the subassemblies and components of the BHA due to operation of the electrocrushing drill assembly can be reduced by actively cooling at least some of the components using a liquid coolant, which can be pumped downhole from a well surface and through at least some of the subassemblies or components of the BHA that require cooling. In some examples, the liquid coolant may be a cryogenic liquid, such as but not limited to, liquid nitrogen. In other examples, the liquid coolant may be chilled water or another coolant.

The liquid coolant may be delivered downhole to a BHA via a liquid coolant conduit. The liquid coolant conduit may extend downhole within a drill string, such as a coiled tubing drill string. Upon reaching the BHA, the liquid coolant may be directed through cooling conduits associated with components to be cooled. For example, the liquid coolant may be directed through heat pipes running under electronic components such as power dissipating semiconductors (e.g., power semiconductors). After passing through the components to be cooled, the liquid coolant may exit the BHA (such as through the drill bit of the electrocrushing drill assembly) and return to the well surface with drilling fluid that is also pumped downhole to support the electrocrushing drilling operation. Like the liquid coolant, the drilling fluid may be pumped downhole through a drilling fluid conduit that extends downhole within the drill string. Power cables, communication cables, or other conduits may also extend downhole within the drill string (e.g., coiled tubing).

In some examples, a single liquid coolant pump disposed at the well surface may be solely responsible for delivering liquid coolant to a downhole BHA including an electrocrushing drill assembly. In another example, liquid coolant may be delivered to a downhole BHA including an electrocrushing drill assembly using a liquid coolant pump disposed at the well surface in conjunction with a coolant pump located at the BHA. In another example, liquid coolant may be delivered to a downhole BHA including an electrocrushing drill assembly using a liquid coolant pump disposed at the well surface in conjunction with multiple coolant pumps located at the BHA. The number of liquid coolant pumps used in a given example may depend on multiple factors, such as for example, the depth of the BHA in the wellbore, the liquid coolant used, the total amount of heat generated by operation of the electrocrushing drill assembly, or other factors.

FIG. 1 is a schematic diagram illustrating the boring of a hydrocarbon well 100 using an electrocrushing drilling technique according to one example of the present disclosure. As shown, the hydrocarbon well 100 drilling operation can include a support frame 102 such as a derrick located at a well (earth) surface 104 surrounding an entrance to a wellbore 106 being drilled. The wellbore 106 of the hydrocarbon well 100 of FIG. 1 is being drilled into a subterranean formation 108. In other examples, a wellbore can be drilled through a sub-sea formation. The wellbore 106 is shown to include a vertical portion in this example. In other examples, a wellbore can alternatively or also include a horizontal portion or an otherwise deviated portion. The well may be a hydraulic fracturing well. Some or the entirety of the wellbore 106 may be an open-hole wellbore in some examples. In other examples, at least a portion of the wellbore 106 may have a casing 110 installed therein. For example, a casing 110 may be installed in the wellbore 106 up to the current drilling depth.

In this example, the support frame 102 is used in a hydrocarbon well 100 drilling operation to deploy into the wellbore 106 (and support) a coiled tubing drill string 112 having a bottomhole assembly (BHA) 114 that includes an electrocrushing drill assembly. For this purpose, a coiled tubing injector 116 may be affixed to the support frame 102 and may receive a supply of coiled tubing 118 from a powered coiled tubing reel 120. The tubing injector 166 can receive the coiled tubing from the coiled tubing reel 120 and direct it into the wellbore 106. In applications where a depth of the wellbore 106 exceeds the overall length of the coiled tubing 118 supplied by the coiled tubing reel 120, one or more additional reels of coiled tubing 118 may be used and the uphole end of the coiled tubing 118 already present in the wellbore 106 can be coupled to a downhole end of a next length of coiled tubing to produce a continuous drill string 112. For example, and as described in more detail below, a given length of the coiled tubing 118 can be coupled to another length of the coiled tubing 118, or to other components or devices, using various types of coupling assemblies. While depicted on the well surface 104 as an onshore drilling operation in FIG. 1, example implementations of an electrocrushing drilling operation may also be performed offshore.

During the wellbore drilling operation, drilling fluid ("mud") 122 from a mud tank 124 can be pumped downhole using a drilling fluid pump 126 driven by a prime mover such as a motor 128. In some examples, the drilling fluid 122 from the mud tank 124 may be pumped into the coiled tubing drill string 112 through a standpipe 130, where it is thereafter conveyed to the drill bit of the downhole electrocrushing drill assembly of the BHA 114. Drilling fluid can exit the drill bit and circulate back to the well surface 104 via an annulus defined between the wellbore 106 and the BHA 114 and the drill string 112. Upon reaching the surface 104, the drilling fluid may pass through a return flow line 132 and can thereafter be processed to fractured rock pieces, etc., such that clean drilling fluid 122 can be returned to the mud tank 124 for subsequent pumping back into the wellbore 106 through the standpipe 130.

In some implementations, the drilling fluid 122 used may be a dielectric drilling fluid. For example, a mixture of drilling mud and one or more dielectric sands may impart the drilling fluid 122 with dielectric properties. While the dielectric sands may increase the viscosity of the drilling fluid 122, their dielectric properties may ensure that electrical discharges emitted from electrodes of the electrocrushing drill assembly do not propagate up the wellbore 106 or to the well surface 104.

As mentioned above, the BHA 114 positioned in the wellbore 106 can include an electrocrushing drill assembly to drill the wellbore 106. In conventional wellbore drilling, a rotary drill bit has cutting elements can be rotated to cause a cutting (fracturing or crushing) of rock. In contrast, electrocrushing drilling uses pulsed power technology where pulsed discharges of electrical energy, which may be short duration, periodic, high-voltage pulses, are discharged between electrodes of an electrocrushing drill bit and through the rock in a surrounding formation. Such discharges may create a plasma that can generate an internal pressure within the rock. The internal pressure may produce a tensional stress that is sufficient to break or fracture the rock. Creation of the plasma and fracturing of the rock of the formation in which the wellbore 106 is drilled may require providing the a substantial amount of electrical energy to the electrocrushing drill assembly.

Figure 2:
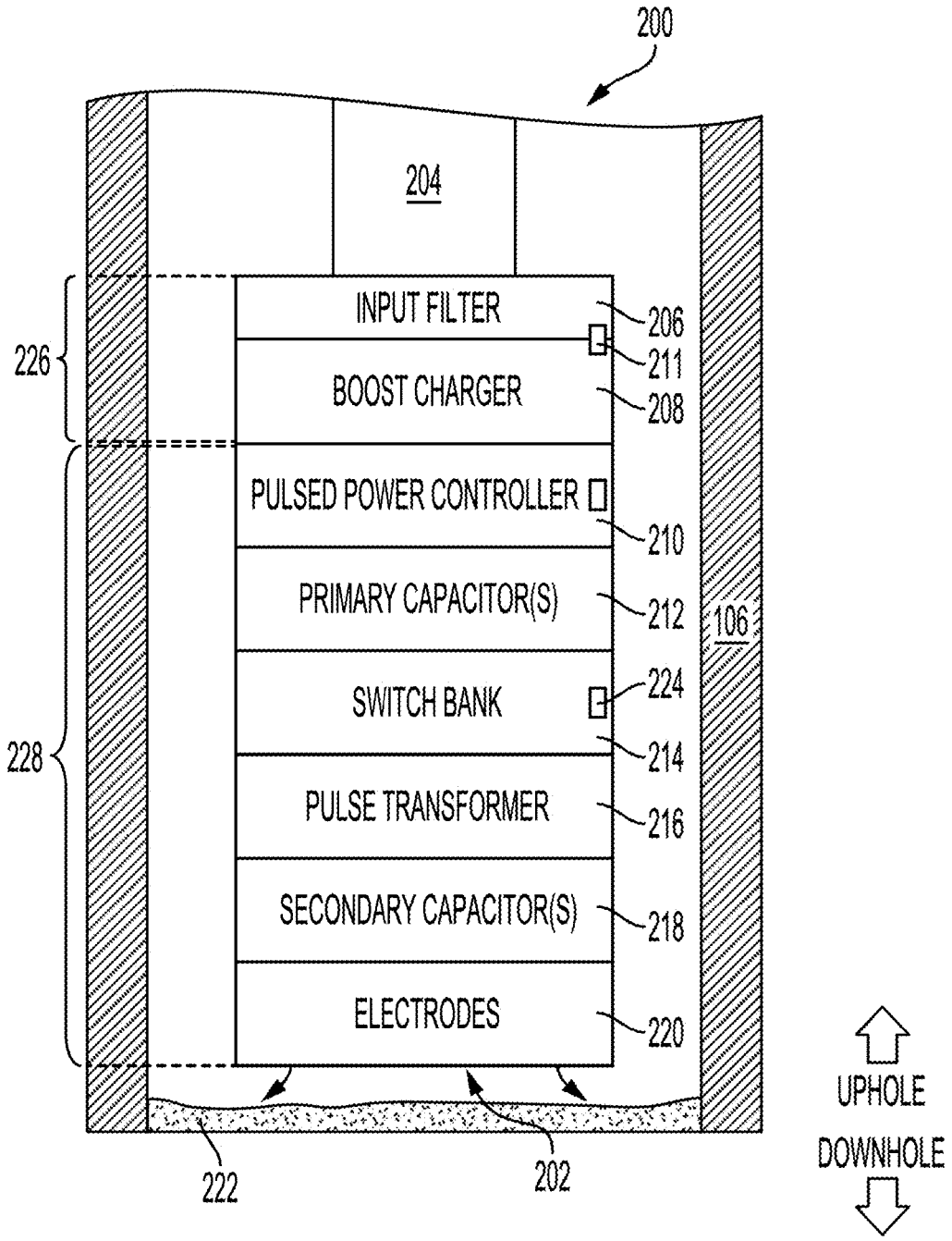
FIG. 2 is schematic diagram depicting various components of a downhole electrocrushing drill assembly according to one example of the present disclosure.

FIG. 2 is schematic diagram depicting a downhole electrocrushing drill assembly 200 portion of an electrocrushing drilling apparatus. The electrocrushing drill assembly 200 is shown to be located in a wellbore, such as the wellbore 106 of FIG. 1. As shown, the electrocrushing drill assembly 200 may be part of a BHA 202 that may be coupled to a downhole end of a drill string 204. In some examples, the drill string 204 may comprise one or more lengths of coiled tubing. The electrocrushing drill assembly 200 may include multiple interconnected subassemblies/components. In some implementations, such as the implementation shown in FIG. 2, the subassemblies/components may include, in an uphole-to-downhole order, an input filter 206, a boost charger 208, a pulsed power controller 210, a primary capacitor(s) 212, a switch bank 214, a pulse transformer 216, a secondary capacitor(s) 218, and an electrocrushing drill bit comprising a plurality of electrodes 220. The downhole electrocrushing drill assembly subassemblies/components or the arrangement of the electrocrushing drill assembly subassemblies/components may be different in other examples.

The subassemblies/components 206-220 depicted in FIG. 2 may be categorized as part of a power conditioning section (PCS) 226 or a pulsed power delivery section 228 of the electrocrushing drilling apparatus. For example, the power conditioning section 226 may include the input filter 206 and the boost charger 208, while the pulsed power delivery section 228 may include the pulsed power controller 210, the switch bank 214 (and switch bank switch(es) 224), the primary capacitor(s) 212, the pulse transformer 216, the secondary capacitor(s) 218, and the electrodes 220. In some implementations, a DC power supply located at the well surface and a power cable used to deliver electrical energy from the DC power supply to the downhole portion of electrocrushing drill assembly 200 may also be part of the pulsed power delivery section 228. The subassemblies/components 206-220 may be categorized differently in other implementations.

According to some examples, the power conditioning section 226 (or PCS) may condition received electrical energy prior to storage of the electrical energy in the primary capacitor(s) 212 and before eventual discharge of the electrical energy from the pulsed power delivery section 228. For example, while DC electrical energy received from a DC power supply located at a well surface may be continuous, the loading of the boost charger 208 may be slightly pulsed rather than exhibiting a continuous power draw. The input filter 206 (which can be more than one input filter) may thus be used to reduce/flatten ripples in the current or voltage output of such a DC power supply or in a power cable used to deliver electrical energy from the DC power supply to the electrocrushing drill assembly 200. Further processing of the electrical energy received at the PCS 226 may include voltage boosting, frequency or waveform smoothing, or regulating of the received electrical energy.

The boost charger 208—which may comprise a voltage booster or similar power converter and a multi-mode capacitor charger—can be positioned downhole of the input filter 206 and can receive filtered electrical energy from the input filter 206. In some implementations, a multi-mode capacitor charger of the boost charger 208 may be a smart charger capable of fast charging. For example, the multi-mode capacitor charger may switch between a constant current mode and a constant power mode to optimize charging of the primary capacitor(s) 212 of the electrocrushing drill assembly 200 depending upon which mode charges the primary capacitor(s) 212 and the secondary capacitor(s) 218 the fastest.

While a single boost charger 208 is depicted in FIG. 2, other example implementations can include two or more boost chargers that may be arranged at different locations along the drill string 204 to boost the voltage of electrical energy received from a power supply at the well surface and to charge the capacitors primary capacitor(s) 212 and the secondary capacitor(s) 218. For example, an additional boost charger may be installed at one or more locations in the coiled tubing of the drill string 204. In some implementations where multiple reels of coiled tubing are conveyed into the wellbore 106 to form the drill string 204, coupling assemblies may be located between each length of coiled tubing and may include an additional boost charger(s). When multiple boost chargers are used, the additional boost chargers may cooperate to increase the voltage of the supplied electrical energy in a stepwise manner until the electrical energy reaches the electrocrushing drill assembly 200, where the boost charger 208 can use the electrical energy to charge the primary and secondary capacitors 212, 218.

A pulsed power electrical discharge from the electrodes 220 may be enabled by the power conditioning section 226 of the electrocrushing drill assembly 200. The power conditioning section 226 may control the charge rate and charge voltage for each electrical energy discharge from the electrodes 220. The power conditioning section 226, using electrical energy supplied by a power supply, may produce an electrical charge in the range of 10-20 kilovolts (kV). The pulsed power controller 210 of the electrocrushing drill assembly 200 may control the pulsed discharge of electrical energy from the electrodes 220 into a formation into which the wellbore 106 is being drilled, into drilling fluid in the wellbore 106, or into a combination of the formation and the drilling fluid. The pulsed power controller 210 may also measure the electrical characteristics of each of the electrical discharges-such as an amount of power, the current, or the voltage emitted by the electrodes 220 of the electrocrushing drill assembly 200. Based on information measured for each discharge, the pulsed power controller 210 may determine information about the drilling operation or about the electrodes 220, including whether the electrodes 220 are firing into the formation (i.e., drilling) or are instead firing into the drilling fluid (i.e., meaning the electrodes 220 are not in contact with the bottom 222 of the wellbore 106).

In some examples, a pulsed electrical discharge by the electrodes 220 may be performed for purposes other than fracturing rock of a formation. For example, a pulsed electrical discharge by the electrodes 220 may deliberately be performed while the electrodes 220 are off the bottom 222 of the wellbore 106 for testing purposes, such as for example, to evaluate the formation. In another example, a pulsed electrical discharge by the electrodes 220 may deliberately be performed for communications purposes.

The pulsed power controller 210 may communicate with the boost charger 208 (e.g., with a controller 211 of the boost charger 208) in some examples. This can enable the pulsed power controller 210 to transmit measured data about the pulsed power drilling operation or drilling operation modification information to the power conditioning section 226 of the electrocrushing drill assembly 200. Likewise, the boost charger 208 (e.g., a controller of the boost charger 208) may communicate with the pulsed power controller 210. This can enable the power conditioning section 226 of the electrocrushing drill assembly 200 to transmit data about and modifications of the pulsed power drilling operation to the pulsed power delivery section 228 of the electrocrushing drill assembly 200.

Communications (e.g., commands) by the pulsed power controller 210 with the boost charger 208 of the power conditioning section 226 of the electrocrushing drill assembly 200 may cause operations of the power conditioning section 226 to ramp up or ramp down. For example, operations of the power conditioning section 226 may ramp up or ramp down in response to characteristics of or changes in electrical energy discharges detected/measured by the pulsed power controller 210. Because the load on the power conditioning section 226 of the electrocrushing drill assembly 200 may be large (due to high voltage electrical being passed therethrough), ramping up and ramping down the operation of the power conditioning section 226 in response to the needs of the pulsed power controller 210 may protect the power conditioning section 226 and associated components thereof from load stress and may extend the lifetime of other components of the electrocrushing drill assembly 200. In an implementation or situation where the pulsed power controller 210 is unable to communicate with the boost controller 208, the power conditioning section 226 may in some examples, cause electrical energy to be supplied to the electrodes 220 at a predetermined constant rate and voltage.

The switch bank 214 may be used to control charging of the primary and secondary capacitor(s) 212, 218. The switch bank 214 may include the switch(es) 224 for this purpose. In some examples, a power supply may continue to supply electrical energy to the electrocrushing drill assembly 200 after the primary capacitor(s) 212 is fully charged. Therefore, once an amount of energy stored in the primary capacitor(s) 212 reaches a defined amount (e.g., the primary capacitor(s) 212 is fully charged), the switch(es) 224 of the switch bank 214 may be opened to prevent overloading the primary capacitor(s) 212. For example, opening the switch(es) 224 may prevent the primary capacitor(s) 212 from storing any additional electrical energy until the electrical energy already stored therein is discharged by way of a pulsed discharge of the electrocrushing drill assembly electrodes 220. The switch(es) 224 of the switch bank 214 may then be closed again to permit the primary capacitor(s) 212 to be recharged.

In some implementations, electrical energy (e.g., DC electrical energy) provided by a power supply may be stored in the primary and secondary capacitor(s) 212, 218 until an electrocrushing drill assembly 200 discharge criteria is satisfied. For example, discharge or load criteria may specify that a defined amount of electrical energy has been stored before a discharge of the electrodes 220 can occur. For example, such criteria may be satisfied when the primary capacitor(s) 212 is fully charged. In another example, such criteria may be satisfied when the amount of electrical energy that has been stored in the primary and secondary capacitor(s) 212, 218 is sufficient to fracture the rock of the subsurface formation at the bottom 222 of the wellbore 106. In the latter case, the amount of electrical energy needed to satisfy the criteria may vary depending on the nature of the rock being drilled by the electrocrushing drill assembly 200. In another example, the criteria may be that a bottom (e.g., the electrodes 220) of the electrocrushing drill assembly 200 of the BHA 202 are in contact with the bottom 222 of the wellbore 106. This may include any contact between the electrodes 220 and the bottom 222 of the wellbore 106, or some defined amount (e.g., surface area) of the electrodes 220 being in contact with the bottom 222 of the wellbore 106. In another example, the discharge criteria may be a defined amount of time since a prior discharge of the electrocrushing drill assembly 200.

Figure 3:
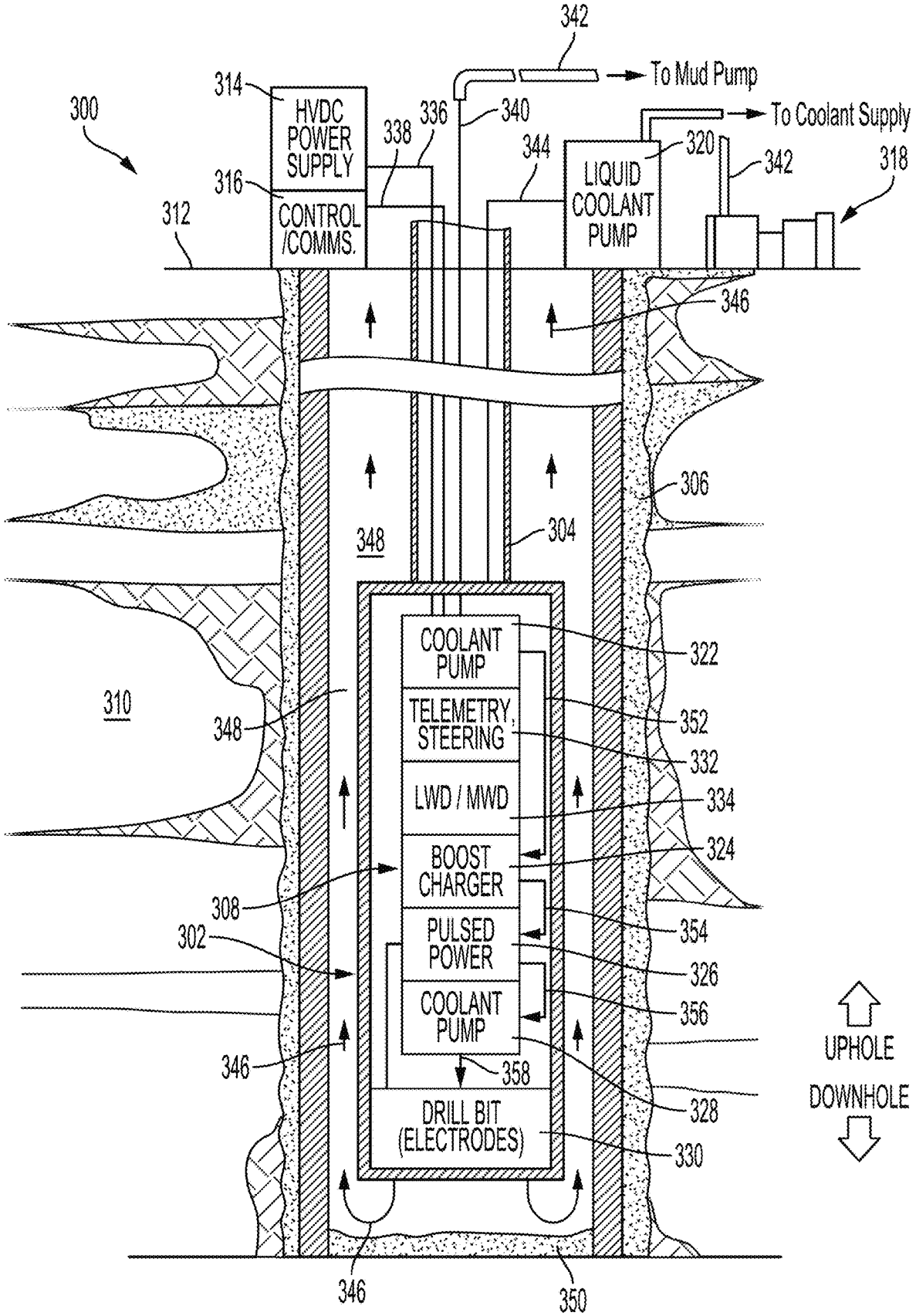
FIG. 3 is a schematic diagram illustrating the use of an electrocrushing drilling apparatus to drill a hydrocarbon well according to one example of the present disclosure.

FIG. 3 is a schematic diagram illustrating the use of an electrocrushing drilling apparatus 300 to drill a hydrocarbon well according to one example of the present disclosure. In this example, a bottomhole assembly (BHA) 302 of a drill string 304 is located in a wellbore 306 of the hydrocarbon well and includes components of a downhole electrocrushing drill assembly 308 portion of the electrocrushing drilling apparatus 300. In this example, the drill string 304 is a coiled tubing drill string. The electrocrushing drilling apparatus 300 may be utilized to advance the wellbore 306 using pulsed power technology which, as described above, employs high voltage electrical energy pulses to fracture rock of the formation 310 within which the wellbore 306 is being drilled.

The electrocrushing drilling apparatus 300 of FIG. 3 may include the downhole electrocrushing drill assembly 308 as well as surface-located components (i.e., components located at a well (earth) surface 312). In this particular example, the surface components of the electrocrushing drilling apparatus 300 are shown to include a high voltage DC power supply 314, a controller and communications unit 316, a motor-driven drilling fluid pump 318, and a surface-located liquid coolant pump 320. The components of this example of the downhole electrocrushing drill assembly 308 are shown to include, in an uphole-to-downhole order, a first downhole coolant pump 322, a boost charger 324, a pulsed power controller 326, a second downhole coolant pump 328, and an electrocrushing drill bit including a plurality of electrodes 330. While not shown in FIG. 3, the electrocrushing drill assembly 308 may also include one or more input filters, a pulsed power controller, a switch bank, a pulse transformer, and primary and secondary capacitor(s) in a like or similar manner to that shown and described relative to the electrocrushing drill assembly 200 of FIG. 2. The components of the electrocrushing drill assembly 308 may also respectively be a part of a power conditioning section or a pulsed power delivery section of the electrocrushing drilling apparatus 300, as previously described. As may further be observed in FIG. 3, the BHA 302 may additionally include components related to other aspects of the drilling operation, such as for example, a telemetry/steering module 332 for guiding the drill string and the electrocrushing drill assembly 308, and a logging while drilling (LWD) or measuring while drilling (MWD) tool 334.

In operation, electrical energy generated by the power supply 314 at the well surface 312 may be conveyed downhole to the electrocrushing drill assembly 308 via a power cable 336 that runs inside the drill string 304. Control commands or other communications between the controller and communications unit 316 and the telemetry/steering module 332 or the LWD/MWD tool 334 may be exchanged by way of a communications cable 338 that may also run inside the drill string 304. The electrical energy conveyed to the electrocrushing drill assembly 308 may be filtered or otherwise conditioned, electrical energy may be stored by charging the capacitor(s), and stored electrical energy may be discharged by the electrodes 330 to fracture the rock or other material of the formation 310 in the manner previously described with respect to operation of the electrocrushing drill assembly 200 of FIG. 2.

In some implementations, the power cable 336 may include a single conductor cable or a multiconductor cable that is capable of conveying high-voltage DC electrical energy downhole to the electrodes 330. In some implementations, the power cable 336 and the communications cable 338 may be combined into a single multiconductor cable. In such an implementation, the multiconductor cable may include a power-carrying conductor that is used to convey electrical energy to the electrocrushing drill assembly 308 and a data-carrying conductor in the form of a fiber optic cable or a coaxial communication cable that may be utilized to transmit data between the well surface 312 and the electrocrushing drill assembly 308. Alternatively or in addition thereto, a fiber optic cable or a coaxial communication cable may be separately deployed downhole within the drill string 304. Using a cable rather than using other communication mediums (e.g., mud pulse telemetry) may enable high speed communication with equipment at the well surface 312. Either or both of the cable(s) 336, 338 may be a single solid cable, a solid multiconductor cable, or a stranded cable, which preferably has low inductance characteristics.

The use of coiled tubing can, in some examples, enable housing of both the power cable 336 and the communications cable 338 within the drill string 304 while simultaneously enabling a drilling fluid conduit 340 fluidly coupled to the mud pump 318 (e.g., by a standpipe 342) and a liquid coolant conduit 344 fluidly coupled to the liquid coolant pump 320 to also extend downhole inside the drill string 304. While the drilling fluid conduit 340 is shown in FIG. 2 to have a diameter that is significantly less than the diameter of the drill string 304 for purposes of clarity, the diameter of the drilling fluid conduit 340 may occupy a majority of the drill string interior space in at least some real-world implementations. Also, in other implementations, it may be possible to isolate the liquid coolant within the drill string 304 using the liquid coolant conduit 344 while permitting the drilling fluid to flow directly through the otherwise hollow interior of the drill string 304. In some implementations, the drilling fluid 122 used may be a dielectric drilling fluid. The dielectric drilling fluid may be a mixture of drilling mud and one or more dielectric sands which may grant the drilling fluid 122 dielectric properties. While the dielectric sands may increase the viscosity of the drilling fluid 122, their dielectric properties may ensure that electrical discharges emitted from the electrodes 220 do not propagate up the wellbore 306 or to the surface 104.

The power cable 336 and the communications cable 338 may be mounted or otherwise secured within the drill string 304. In some implementations, the power cable 336 and the communications cable 338 may be pre-assembled within the coiled tubing of the drill string 304. In other implementations, the power cable 336 and the communications cable 338 may instead be mounted or strapped to the outside of the drill string 304. The power cable 336 or the communications cable 338 can be mounted or strapped to the outside of the drill string 304 in a manner that enables the cable(s) 336, 338 to generally withstand a downhole hydrocarbon well environment, including but not limited to, resisting a fast-moving and possibly highly viscous upward flow of drilling fluid 346 that travels within an annulus 348 of the wellbore 306 after being expelled from the electrocrushing drill assembly 308 along a bottom 350 of the wellbore 306.

While conveying the power cable 336 or the communications cable 338 to depth within a drill string comprising traditional segmented pipe may prove exceedingly difficult, the process may be simplified by use of coiled tubing drill string. For example, a coiled tubing reel may comprise up to, for example, 5,000 ft of coiled tubing, whereas a stand (typically comprising three or four individual joints) of segmented drill pipe may be between 30-55 feet in length. Thus, use of the segmented drill pipe may require that additional drill pipe be added every 30-55 feet of drilling and running the power cable 336 or the communications cable 338 within the drill string 304 in such a configuration may be difficult in comparison to running the power cable 336 or the communications cable 338 within a coiled tubing drill string 304 of far greater length. Running the power cable 336 and the communications cable 338 within the coiled tubing drill string 304 can result in an integrated, fast drilling architecture using an electro-hydraulic BHA configuration.

In some implementations, a coiled tubing reel(s) used at the well surface 312 to store coiled tubing used for the drill string 304 may have an inductance that is greater than that of the power cable 336, the communications cable 338, or the electrocrushing drill assembly 308 located in the wellbore 306. The greater inductance of the coiled tubing reel(s) may result from the presence of the power cable 336 within the coiled tubing wound around the coiled tubing reel. The inductance of the coiled tubing reel may thus increase as the number of turns of the coiled tubing wound around the reel increases. Contrarily, as more coiled tubing is conveyed into the wellbore 306, the inductance of the coiled tubing reel may decrease. The difference in inductance between the coiled tubing reel and the power cable 336 in the wellbore 306 may induce a voltage overshot or ringing from the power supply 314 when conveying pulsed power to the capacitor(s) of the electrocrushing drill assembly 308. In some examples, one or more input filters as described above may be communicatively coupled to the power cable 336 and, as such, to the power supply 314, to reduce any ringing caused by inductance discrepancies between the coiled tubing reel and the power cable 336.

In some implementations, using coiled tubing for the drill string 304 may allow for longer wells to be drilled using the electrocrushing drilling apparatus 300. For example, running the power cable 336 through a drill string 304 comprising one or more lengths (e.g., reels) of coiled tubing can enable delivery of consistent and direct electrical energy from the power supply 310 to the downhole components of the electrocrushing drill assembly 308 even when the downhole components of the electrocrushing drill assembly 308 are located at substantial depth. For example, the electrocrushing drilling apparatus 300 may be able to drill the wellbore 306 to a depth of 2-3 miles vertically when provided with electrical energy from the power supply 314 via the power cable 336 running within the coiled tubing drill string 304. Similarly, the electrocrushing drill assembly 308 may be able to extend the wellbore 306 up to 7 miles laterally when provided with electrical energy from the power supply 314 via the power cable 336 running within the coiled tubing drill string 304. In addition to powering the electrodes 330 of the electrocrushing drill assembly 308, the electrical energy provided by the power supply 314 may be used to power the telemetry/steering module 332 (which may comprise geosteering equipment), the LWD/MWD tool 334, a nuclear magnetic resonance (NMR) tool, etc.

The power cable 336 may be configured to reduce conduction losses and total voltage drop as electrical energy travels from the power supply 314 to the electrocrushing drill assembly 308. For example, the power cable 336 may be able to efficiently deliver up to 1,000 kilowatts (kW) of impedance-matched electrical energy to the electrocrushing drill assembly 308 with minimal losses. In some implementations, the power cable 336 may deliver electrical energy at approximately 200 kilovolts (kV) to the electrocrushing drill assembly 308. In some implementations, the power cable 336 may be a high-temperature superconducting (HTS)

cable. In some implementations, it may be possible to cool a HTS cable using the liquid coolant as it flows from the well surface to the BHA 302.

Using the power cable 336 to convey the electrical power to the electrocrushing drill assembly 308 may also improve the overall thermal efficiency of the electrocrushing well drilling operation. For example, heat losses from the power cable 336 may be distributed within the wellbore 306 across the entire length of the power cable 336. Utilizing the power cable 336 to deliver electrical energy to the electrocrushing drill assembly 308 can also eliminate the need for a complex power downhole power conversion apparatus. The power topology comprising the power supply 314, the power cable 336, and the boost charger 324 may reduce power losses during the delivery of a required amount of electrical energy to the electrodes 330 of the electrocrushing drill assembly 308.

Nonetheless, a significant amount of electrical energy can still be dissipated during operation of the electrocrushing drill assembly 308. This dissipation of electrical energy may result in a buildup of excess heat in the wellbore 306. Due to the possible magnitude of the power losses, the amount of excess heat generated can be substantial. The excess heat may be passed to various components of the electrocrushing drill assembly 308, or to other components of the BHA 302 such as for example, electronic components of the telemetry/steering module 332 or the LWD/MWD tool 334. The excessive heat may be harmful to these components, especially to electronic components such as, for example, semiconductor devices or transformers.

Thus, it is desirable to reduce the amount of heat to which downhole components may be exposed as a result of operating the electrocrushing drill assembly 308. However, in the downhole environment of the wellbore 306, there may be no or very limited natural cooling because the ambient temperature may be quite high. Likewise, the drilling fluid 346 pumped downhole to the operating area of the electrocrushing drill assembly electrodes 330 is typically not an effective heat transfer medium.

Therefore, the present disclosure presents example techniques for actively cooling at least some of the components of the BHA 302 by pumping a liquid coolant from the well surface 312 downhole to the BHA 302 and through the at least some of the BHA components. The liquid coolant may be, for example, a cryogenic liquid such as but not limited to liquid nitrogen, or chilled water. As shown in FIG. 3 and referenced above, the surface-located liquid coolant pump 320 may deliver the liquid coolant downhole to the BHA 302 via the liquid coolant conduit 344 that runs within the drill string 304, or possibly by using the drill string 304 itself as a drilling fluid conduit.

The liquid coolant used and the flow rate of the liquid coolant to the BHA 302 may depend on a number of factors, including for example, the electrocrushing drilling (operating) rate, the efficiency of the electrocrushing drill assembly 308, the nature of the power cable 336 (e.g., superconducting or not superconducting), the ambient environment at the drilling depth, etc. For example, in an implementation where the electrodes 330 of the electrocrushing drill assembly 308 are discharging at a pulse rate of 200 pulses per second and at 1 KJ per pulse, the energy delivered to the formation 310 is 200 KJ. Then, assuming for example, a worst-case electrocrushing drill assembly 308 operating efficiency of 50% (which may be higher in real-world operation), the power losses of the electrocrushing drill assembly 308 may be approximately 200 KJ.

In an example where the selected liquid coolant is liquid nitrogen, for example, the associated heat of vaporization is 200 KJ/Kg. Thus, in order to counteract the heat buildup in the wellbore 306 due to the stated power losses of the electrocrushing drill assembly 308, the liquid nitrogen may be pumped downhole to the BHA 302 at a rate of approximately 1,250 milliliters per second, which is approximately 20 gallons per minute. Given that a typical liquid nitrogen tanker truck has a capacity of approximately 3,000 gallons, one tanker truck of liquid nitrogen could sustain a cooling operation of the BHA 302 for approximately 2.5 hours at the stated pump rate of 20 gallons per minute. In another example where the selected liquid coolant is chilled water, the associated heat of vaporization is 2,000 KJ/Kg. Thus, in order to counteract the heat buildup in the wellbore 306 due to the stated power losses of the electrocrushing drill assembly 308, the chilled water may be pumped downhole to the BHA 302 at a rate of approximately 100 milliliters per second, which is approximately 1.6 gallons per minute. Thus, these examples demonstrate that actively cooling a downhole electrocrushing drill assembly using pumped liquid coolant can be an effective solution to reducing downhole heat buildup.

In the example of FIG. 3, the electrocrushing drill assembly 308 includes the aforementioned first downhole coolant pump 322 and the second coolant pump 328. In other examples of a downhole portion of an electrocrushing drill assembly, a single liquid coolant pump disposed at the well surface may be solely responsible for delivering liquid coolant to a downhole BHA or liquid coolant may be delivered to a downhole BHA using a liquid coolant pump disposed at the well surface in conjunction with a single coolant pump located at the BHA. In another example, liquid coolant may be delivered to a downhole BHA using a liquid coolant pump disposed at the well surface in conjunction with more than two coolant pumps located at the BHA. The number of liquid coolant pumps used in a given example may depend on multiple factors, such as for example, the depth of the BHA in the wellbore, the liquid coolant used, the total amount of heat generated by operation of the electrocrushing drill assembly, etc.

In the example implementation shown in FIG. 3, the liquid coolant pumped downhole from the well surface 312 may be received by the first downhole coolant pump 322 upon reaching the BHA 302. The first downhole coolant pump 322 may operate to increase the flow rate and pressure of the liquid coolant (to maintain a proper pressure differential) and may direct the liquid coolant to a downhole component of the electrocrushing drill assembly 308. In this particular example, the first downhole coolant pump 322 directs a flow 352 of the liquid coolant to the boost charger 324 of the electrocrushing drill assembly 308. The boost charger 208 may be cooled by the liquid coolant. From the boost charger 324, a flow 354 of the liquid coolant may enter the pulsed power controller 326. The pulsed power controller 326 may be cooled by the liquid coolant. From the pulsed power controller 326, a flow 356 of the liquid coolant may pass to the second downhole coolant pump 328. The second downhole coolant pump 328 may operate to increase the flow rate and pressure of the liquid coolant and may thereafter direct a flow 358 of the liquid coolant to the electrodes 330 of the electrocrushing drill assembly 308 to cool the electrodes 330.

At least when the liquid coolant is a cryogenic liquid such as liquid nitrogen, the liquid coolant may exit the electrodes 330 of the electrocrushing drill assembly 308 any may travel upward to the well surface with the drilling fluid 346. In some example implementations, such as for example and implementation where the liquid coolant is a reusable coolant such as chilled water, it may be possible to reuse the liquid coolant by incorporating a liquid coolant return circuit that can return the liquid coolant from the BHA 302 to the well surface for re-cooling and subsequent recirculation instead of expelling the liquid coolant into the wellbore 306. In some examples, a second liquid coolant pump at the well surface 312 may be provided and used to further regulate the flow and pressure of the liquid coolant and to ensure that the temperature of the liquid coolant is well below its boiling point by pumping back or pumping out excess liquid coolant.

Figure 6:
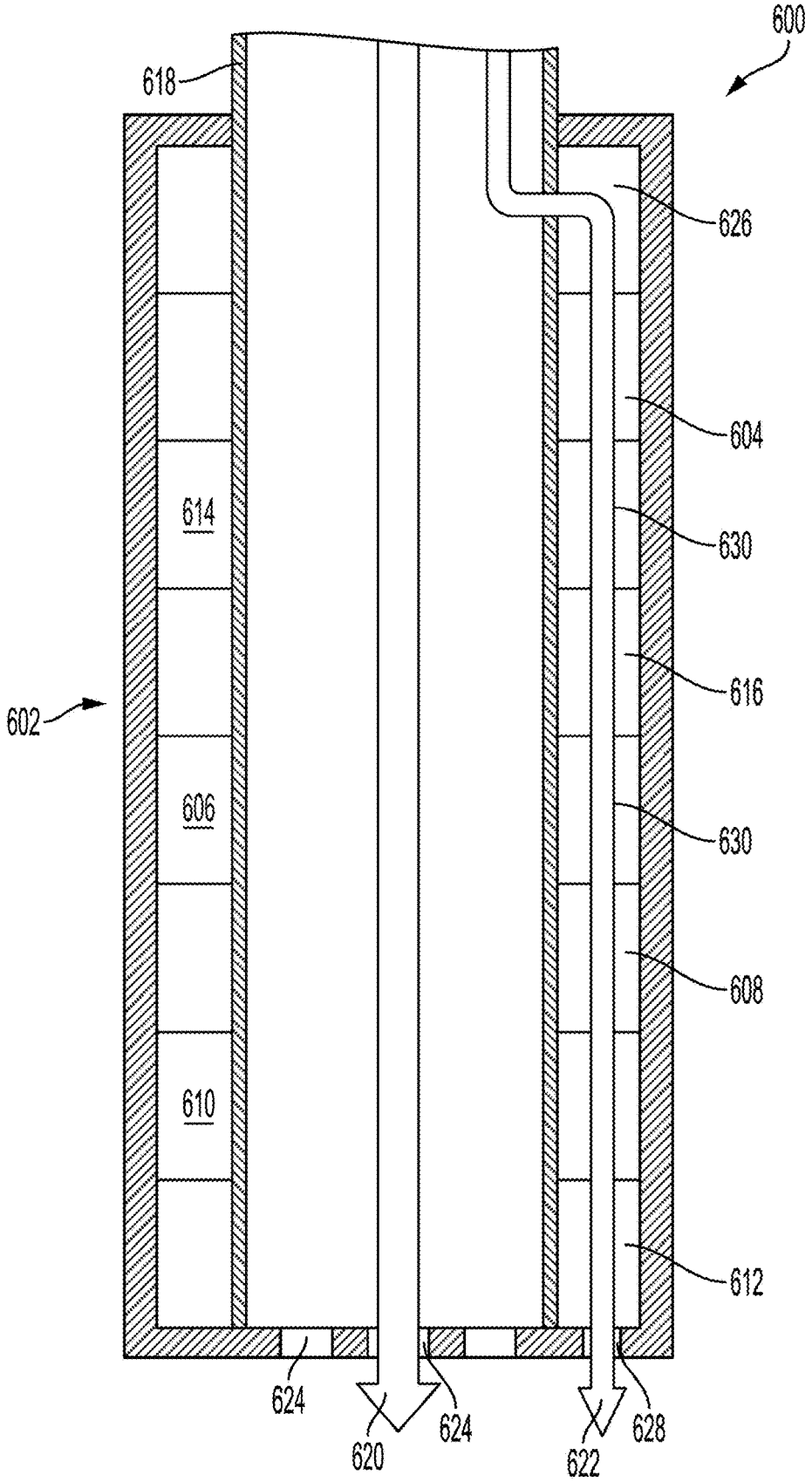
FIG. 6 is a schematic diagram illustrating a drilling fluid flow path and a liquid coolant flow path through various downhole components of an electrocrushing drill assembly according to one example of the present disclosure.

As is described in more detail relative to FIG. 6, upon being directed to different components of the electrocrushing drill assembly 308 to be cooled, the liquid coolant may be pass through cooling conduits associated with the components to be cooled. For example, the liquid coolant may be directed through heat pipes running under electronic components such as power dissipating semiconductors.

Figure 4:
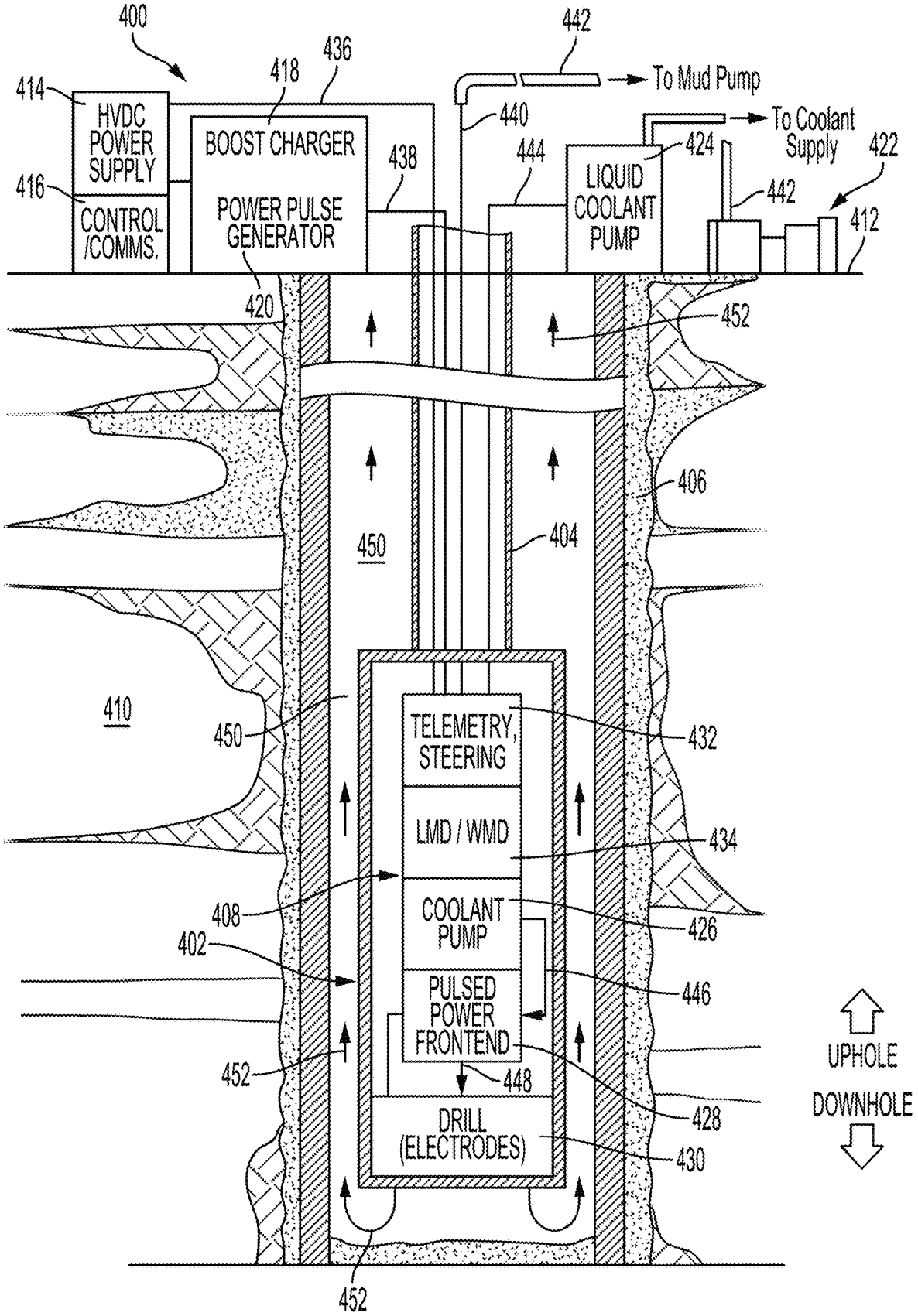
FIG. 4 is a schematic diagram illustrating use of another electrocrushing drilling apparatus to drill a hydrocarbon well according to another example of the present disclosure.

FIG. 4 is a schematic diagram illustrating the use of an electrocrushing drilling apparatus 400 to drill a hydrocarbon well according to another example of the present disclosure. In this example, a bottomhole assembly (BHA) 402 of a drill string 404 is located in a wellbore 406 of the hydrocarbon well 400 and includes components of downhole electrocrushing drill assembly 408 portion of the electrocrushing drilling apparatus 400. Many aspects of the electrocrushing drilling apparatus 400 and the associated electrocrushing drilling operation illustrated in FIG. 4 may be the same or similar to the electrocrushing drilling operation illustrated in FIG. 3. For example, the drill string 404 located in the wellbore 406 in FIG. 4 is a coiled tubing drill string, and the electrocrushing drilling apparatus 400 may be utilized to advance the wellbore 406 using pulsed power technology to fracture rock of the formation 410 within which the wellbore 406 is being drilled.

As with the electrocrushing drilling apparatus 300 of FIG. 3, the electrocrushing drilling apparatus 400 may include surface components (i.e., components located at a well (earth) surface 412) in addition to the components of the downhole electrocrushing drill assembly 408. In this particular example, the surface components of the electrocrushing drilling apparatus 400 are shown to include a high voltage DC power supply 414, a controller and communications unit 416, a boost charger 418, a power pulse generator 420, a motor-driven drilling fluid ("mud") pump 422, and a surface-located liquid coolant pump 424. The components of the downhole electrocrushing drill assembly 408 are shown to include, in an uphole-to-downhole order, a downhole coolant pump 426, a pulsed power frontend subassembly 428, and a drill bit comprising a plurality of electrodes 430. While not shown in FIG. 4, the electrocrushing drill assembly 408 may also include one or more input filters, a switch bank, and primary and secondary capacitor (s) in a like or similar manner to that shown and described relative to the electrocrushing drill assembly 200 of FIG. 2. The components of the electrocrushing drilling apparatus 400 may also respectively be a part of a power conditioning section or a pulsed power delivery section of the electrocrushing drilling apparatus 400, as previously described. As may further be observed in FIG. 4, the BHA 402 may additionally include components related to other aspects of the drilling operation, such as for example, a telemetry/steering module 432 for guiding the drill string and the electrocrushing drill assembly 408, and a logging while drilling (LWD) or measuring while drilling (MWD) tool 434.

As can be understood by a comparison of the electrocrushing drill assembly 408 of FIG. 4 to the electrocrushing drill assembly 308 of FIG. 3, the electrocrushing drill assembly 408 of FIG. 4 includes only a single downhole coolant pump 420 and the boost charger 418 and a power pulse generator 420 are located at the well surface 412 instead of downhole in the wellbore 406. The system architecture of FIG. 4 thus represents an implementation where a direct high voltage electrical energy pulse is deliverable directly to the electrocrushing drill bit (i.e., to the electrodes 430) of the electrocrushing drill assembly 408.

In operation, electrical energy generated by the power supply 414 at the well surface 412 may be conveyed downhole to the electrocrushing drill assembly 408 via a power cable 436 that runs inside the drill string 404. Control commands or other communications between the controller and communications unit 416 and the telemetry/steering module 432 or the LWD/MWD tool 434 may be exchanged by way of a communications cable 438 that may also run inside the drill string 404. The power cable 436 and the communications cable 438 may be of any construction described above relative to the power cable 336 and the communications cable 338 of FIG. 3. Likewise, the power cable 436 and the communications cable 438 may be secured to the inside or the outside of the drill string 404 in any manner described above relative to securing the power cable 336 and the communications cable 338 to the drill string 304 of FIG. 3. The power cable 436 and the communications cable 438 may otherwise function to deliver electrical energy, control commands, other communications, etc., downhole to the components of the BHA 402 in a like manner to the power cable 336 and the communications cable 338 of FIG. 3. Likewise, both the power cable 436 and the communications cable 438 may be housed within the drill string 404 while simultaneously enabling a drilling fluid conduit 440 fluidly coupled to the drilling fluid pump 422 (e.g., by a standpipe 442) and a liquid coolant conduit 444 fluidly coupled to the liquid coolant pump 424 (or to a liquid coolant supply) to also extend downhole inside the drill string 404. In other implementations, it may be possible to isolate the liquid coolant within the drill string 404 using the liquid coolant conduit 444 while permitting the drilling fluid to flow directly through the otherwise hollow interior of the drill string 404. In some implementations, the drilling fluid 122 used may be a dielectric drilling fluid as described above.

The electrical energy conveyed to the electrocrushing drill assembly 408 may be filtered or otherwise conditioned, electrical energy may be stored by charging capacitor(s), and stored electrical energy may be discharged by the electrodes 430 to fracture the rock or other material of the formation 410 in the manner previously described with respect to operation of the electrocrushing drill assembly 200 of FIG. 2.

In the electrocrushing drilling apparatus 400 of FIG. 4, moving the boost charger 418 and the power pulse generator 420 to the well surface 412 can simplify the construction of the electrocrushing drill assembly 408, such as by enabling the pulsed power frontend 428 of the electrocrushing drill assembly 408 to include only minimal circuit elements. For example, the pulsed power frontend 428 may include only a secondary capacitor, a diode, and voltage and current sensors in some implementations. This can reduce the amount of heat generated by the electrocrushing drill assembly 408 during operation.

Nonetheless, a significant amount of electrical energy can still be dissipated during operation of the electrocrushing drill assembly 408. This dissipation of electrical energy may result in a buildup of excess heat in the wellbore 406. Due to the possible magnitude of the power losses and ambient conditions of the wellbore 406 in the operating area of the electrocrushing drill assembly 408, the amount of excess heat generated can be substantial. As with operation of the electrocrushing drill assembly 308, the excess heat may be passed to various components of the electrocrushing drill assembly 408, or to other components of the BHA 402 such as for example, electronic components of the telemetry/steering module 432 or the LWD/MWD tool 434. The excessive heat may be harmful to these components, especially to electronic components such as, for example, semiconductor devices or transformers.

Consequently, it is also desirable to reduce the amount of heat to which downhole components of the electrocrushing drill assembly 408 may be exposed during operation. This can be accomplished, as described above relative to the electrocrushing drilling operation of FIG. 3, by actively cooling at least some of the components of the BHA 402 using a liquid coolant pumped from the well surface 412 downhole to the BHA 402 and through the at least some of the BHA components. The liquid coolant may be, for example, any of the liquid coolants identified above relative to cooling one or more components of the BHA 302 of FIG. 3, and the liquid coolant used and the flow rate of the liquid coolant to the BHA 402 may be determined in the same or a similar manner to that described relative to the electrocrushing drilling operation of FIG. 3. The liquid coolant pump 424 may deliver the liquid coolant downhole to the BHA 402 via the liquid coolant conduit 444 that runs within the drill string 404 or by using the drill string 404 itself as a drilling fluid conduit.

In the example implementation shown in FIG. 4, the liquid coolant pumped downhole from the well surface 412 may be received by the downhole coolant pump 426 upon reaching the BHA 402. The downhole coolant pump 426 may operate to increase the flow rate and pressure of the liquid coolant, and may direct the liquid coolant to a downhole component of the electrocrushing drill assembly 408. In this particular example, the downhole coolant pump 426 directs a flow 446 of the liquid coolant to the pulsed power frontend 428 of the electrocrushing drill assembly 408. The electronic components of the pulsed power frontend 428 may be cooled by the liquid coolant. From the pulsed power frontend 428, a flow 448 of the liquid coolant may be directed to the drill bit electrodes 430 of the electrocrushing drill assembly 408 to cool the electrodes 430.

At least when the liquid coolant is a cryogenic liquid such as liquid nitrogen, the liquid coolant may exit the electrodes 430 of the electrocrushing drill assembly 408 any may travel upward via a wellbore annulus 450 to the well surface 412 with drilling fluid 452 that is expelled from the electrocrushing drill assembly 408 along with the liquid hydrogen coolant. In some example implementations, such as for example and implementation where the liquid coolant is a reusable coolant such as chilled water, it may be possible to reuse the liquid coolant by incorporating a liquid coolant return circuit that can return the liquid coolant from the BHA 402 to the well surface for re-cooling and subsequent recirculation. In some examples, a second liquid coolant pump may be located at the well surface 412 and used to regulate the flow and pressure of the liquid coolant and to ensure that the temperature of the liquid coolant is well below its boiling point by pumping back or pumping out excess liquid coolant.

As is described in more detail relative to FIG. 6, upon being directed to different components of the electrocrushing drill assembly 408 to be cooled, the liquid coolant may pass through cooling conduits associated with the components to be cooled. For example, the liquid coolant may be directed through heat pipes running under electronic components such as power dissipating semiconductors.

Figure 5:
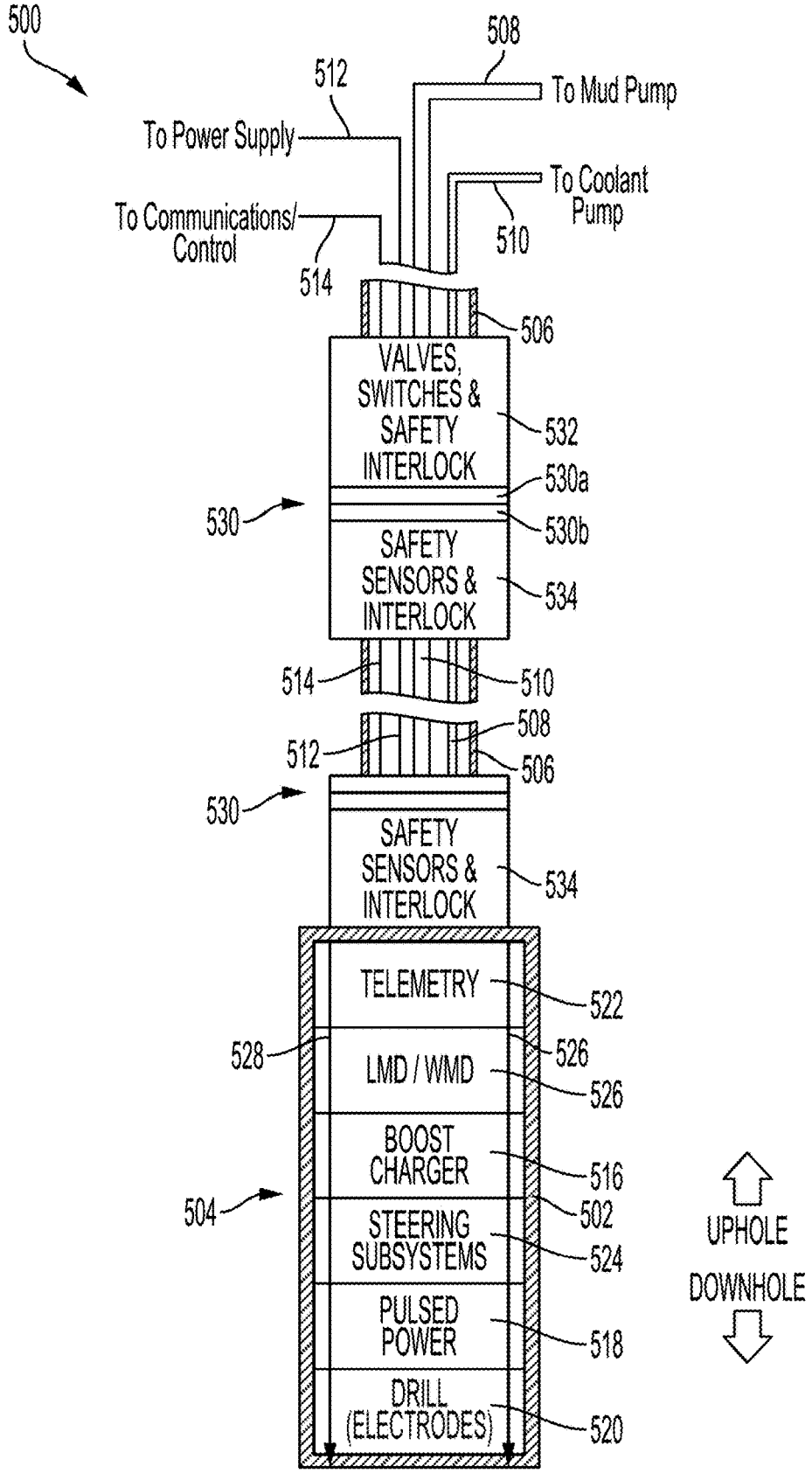
FIG. 5 is a schematic diagram illustrating various connected components of a hydrocarbon well coiled tubing drill string, including a bottomhole assembly comprising components of an electrocrushing drill assembly according to one example of the present disclosure.

FIG. 5 is a schematic diagram illustrating various connected components of a modular hydrocarbon well drill string 500, including a bottomhole assembly (BHA) 502 comprising various downhole components of an electrocrushing drill assembly 504 of an electrocrushing drilling apparatus. Many aspects of the electrocrushing drill assembly 504 illustrated in FIG. 5 may be the same or similar to the electrocrushing drill assembly 308 of FIG. 3 and the electrocrushing drill assembly 408 of FIG. 4. For example, the electrocrushing drill assembly 504 may be arranged at a downhole end of the drill string 500, which may be assembled from coiled tubing 506. The electrocrushing drilling apparatus may also include surface components (i.e., components located at a well (earth) surface. The surface components may include, for example, any combination of power supplies, control and communications units, drilling fluid pumps, liquid coolant pumps, etc., described above relative to the electrocrushing drilling apparatus 300, 400 of FIGS. 3-4. As with the electrocrushing drilling apparatus 400 of FIG. 4, at least some components of the electrocrushing drill assembly 504 that are optionally deployed downhole, such as a boost charger 516, may instead be located at the well surface. As in the previously described examples, electrical energy conveyed to the electrocrushing drill assembly 504 may be filtered or otherwise conditioned, electrical energy may be stored by charging capacitor(s), and stored electrical energy may be discharged by electrodes 520 to fracture the rock or other material of a formation.

It may be further observed in FIG. 5 that a drilling fluid conduit 508 can be provided to convey drilling fluid downhole to and through the BHA 502 and a liquid coolant conduit 510 can be provided to convey liquid coolant downhole to components of the BHA 502. Likewise, a power cable 512 can be provided to convey electrical energy from a surface-located power supply downhole to components of the electrocrushing drill assembly 504 and possibly to other components of the BHA 502 such as a telemetry module 522, a steering subsystems module 524, or a LWD or MWD tool 526, and a communications cable 514 can be provided to transmit commands or other communications between one or more components of the BHA 502 and a surface-located control and communications unit. As in the previous examples, all of the drilling fluid conduit 508, the liquid coolant conduit 510, the power cable 512, and the communications cable 514 may extend downhole within the interior space of the coiled tubing 506 of the drill string 500 in some implementations. In other implementations, the power cable 512, the communications cable 514, or both, may instead be secured to the outside of the coiled tubing 506 of the drill string 500. In still other implementations, the coiled tubing 506 itself may serve as a conduit for conveying the drilling fluid.

This particular example of the BHA 502 may be observed to include downhole components of the electrocrushing drill assembly 504 comprising the boost charger 516, a pulsed power controller 518, and an electrocrushing drill in the form of a plurality of electrodes 520. The BHA 502 may be observed to further include the aforementioned telemetry module 522, the steering subsystems module 524, and the LWD/MWD tool 526. A BHA 502 in other examples of an electrocrushing drilling operation may include different components, a different arrangement of components, or both. For example, the BHA 502 may include the components shown and described above relative to the electrocrushing drilling operation of FIG. 3 or the electrocrushing drilling operation of FIG. 4.

At least some of the components of the BHA 502 may be actively cooled using a liquid coolant pumped downhole from the well surface in a like or similar manner to that described above relative to the electrocrushing drilling operations of FIGS. 3-4. The liquid coolant may be, for example, any of the liquid coolants identified above relative to cooling one or more components of the BHA 302 of FIG. 3, and the liquid coolant used and the flow rate of the liquid coolant to the BHA 502 may be determined in the same or a similar manner to that described relative to the electrocrushing drilling operation of FIG. 3. One or more liquid coolant pumps may deliver the liquid coolant from a surface-located liquid coolant source to the BHA 502 via the liquid coolant conduit 510 that runs within the drill string 506, or by using the coiled tubing 506 of the drill string 500 as a drilling fluid conduit. In operation, a flow of liquid coolant 526 and a flow of drilling fluid 528 may pass through the BHA 502 and exit the electrocrushing drill electrodes 520 into a wellbore in which the BHA 502 is located. One or more components of the BHA 502 may be cooled by the liquid coolant.

As mentioned above, FIG. 5 represents a modular hydrocarbon well drill string 500. While the drill string 500 may be assembled using a single length of the coiled tubing 506 in some examples, it is possible that a depth of the wellbore being drilled may exceed a maximum length of a reel of the coiled tubing, or even multiple reels of the coiled tubing 506. In such a case, the drill string 500 may include multiple reels of the coiled tubing 506 that are joined together to reach a desired wellbore depth.

When multiple sections of the coiled tubing 506 are joined to form the drill string 500, the sections of the coiled tubing 506 may be coupled together using one or more coupling assemblies 530. Each coupling assembly 530 may have an uphole portion **530*a* that can be coupled to a downhole end of an uphole section of the coiled tubing 506 or a downhole end of a drill string component that is otherwise coupled to the coiled tubing 506. Each coupling assembly 530 may also have a cooperating downhole portion 530*b* that can be coupled to an uphole end of a downhole section of the coiled tubing 506 or an uphole end of a drill string component that is otherwise coupled to the coiled tubing 506. The coupling assemblies 530 may include connections that enable the drilling fluid conduit 508, the liquid coolant conduit 510, the power cable 512, and the communications cable 514 to be easily extended from an uphole section of the coiled tubing 506 to a downhole section of the coiled tubing 506** that is coupled thereto.

While the drill string components to which a coupling assembly may be coupled can vary in different implementations, the drill string components of the modular drill string 500 of FIG. 5 may include, for example, one or more valves, switches and interlock components 532 and one or more sensors and interlock components 534. In some examples, a valves, switches and interlock component 532 may include controllable valves via which a downhole flow of drilling fluid or liquid coolant can be adjusted or stopped. A valves, switches and interlock component 532 may also include one or more controllable switches via which a downhole flow of electrical energy to the components of the BHA 502 can be connected or disconnected. In some examples, a sensor and interlock component 534 may include sensors that can monitor the operation of one or more components of the BHA 502, such as components of the electrocrushing drill assembly 504, or the telemetry module 522, the steering subsystems module 524, or the LWD/MWD tool 526. The sensors may communicate with equipment at the well surface, such as by way of the communications cable 514. Signals generated by the sensors may be used to adjust the electrocrushing drilling, steering of the electrocrushing drill assembly 504, etc., or to indicate a problem that requires at least a temporary cessation of the electrocrushing drilling operation.

FIG. 6 is a schematic diagram illustrating a drilling fluid flow path and a liquid coolant flow path through various components of a downhole electrocrushing drill assembly 600 portion of an electrocrushing drilling apparatus according to one example of the present disclosure. The electrocrushing drill assembly 600 may again be part of a bottomhole assembly (BHA) 602 supported on a downhole end of a drill string, such as a coiled tubing drill string. The electrocrushing drill assembly 600 may include any of the downhole components and any of the component arrangements of the electrocrushing drilling assemblies 308, 408, 504 of FIGS. 3-5. For example, the downhole components of the electrocrushing drill assembly 600 may be the same as those shown in FIG. 3, including, in an uphole-to-downhole order, a first downhole coolant pump 604, a boost charger 606, a pulsed power controller 608, a second downhole coolant pump 610, and a electrocrushing drill bit comprising a plurality of electrodes 612. The BHA 602 may additionally include components related to other aspects of the drilling operation, such as for example, a telemetry/steering module 614 for guiding the drill string and the electrocrushing drill assembly 600, and a logging while drilling (LWD) or measuring while drilling (MWD) tool 616.

As shown, a central conveyance conduit 618 may pass through the BHA 602 and may act as a pathway for a flow of drilling fluid 620 and a flow of liquid coolant 622. In some examples, the central conveyance conduit 618 be coupled to an end of the drill string (e.g., to the coiled tubing). In some implementations, the central conveyance conduit 618 may be a shorter section of coiled tubing that extends through at least some of the downhole components of the electrocrushing drill assembly 600.

The central conveyance conduit 618 may be located along a central longitudinal axis of the electrocrushing drill assembly 600 and may have an overall outside diameter that is smaller than an inside diameter of a body of the electrocrushing drill assembly 600. As such, a space(s) 626 may be created between an outside surface of the central conveyance conduit 618 and an inside wall of the body of the electrocrushing drill assembly 600. This space(s) may be used to house the components 604-612 of the electrocrushing drill assembly 600, as well as the telemetry/steering module 614 and LWD/MWD tool 616. An input filter(s), a switch bank(s), capacitors(s), and other downhole components of the electrocrushing drill assembly 600 not shown in FIG. 6 may also be located in this space(s) 626. These components may be directly or indirectly affixed to the outside surface of the central conveyance conduit 618 or the inside wall of the of the body of the electrocrushing drill assembly 600 in some implementations. For example, a frame may be secured within the space(s) 626 and the components may be affixed to the frame so as to be arranged in the path of the flow of liquid coolant 622.

The flow of drilling fluid 620 may pass through the downhole components of the electrocrushing drill assembly 600 as well as the telemetry/steering module 614 and LWD/MWD tool 616 of the BHA 602. Once the flow of drilling fluid 620 reaches the electrodes 612 of the electrocrushing drill assembly 600, the flow of drilling fluid 620 may be expelled through one or more ports or nozzles 624 located in or in proximity to the electrodes 612 and may flow upward toward a well surface surrounding the wellbore in which the electrocrushing drill assembly 600 is located.

The flow of liquid coolant 622 may pass from within the central conveyance conduit 618 into the space(s) 626 between the central conveyance conduit 618 and the body of the electrocrushing drill assembly 600. The flow of liquid coolant 622 may thereafter pass through the downhole components of the electrocrushing drill assembly 600 as well as the telemetry/steering module 614 and LWD/MWD tool 616 of the BHA 602. Once the flow of liquid coolant 622 reaches the electrodes 612 of the electrocrushing drill assembly 600, the flow of liquid coolant 622 may be expelled through one or more ports or nozzles 628 located in or in proximity to the electrodes 612 and may flow upward along with the drilling fluid toward the well surface surrounding the wellbore in which the electrocrushing drill assembly 600 is located.

When passing through the downhole components of the electrocrushing drill assembly 600 and the telemetry/steering module 614 and LWD/MWD tool 616 located in the BHA 602, the liquid coolant may more specifically pass through cooling conduits associated with the components to be cooled. For example, the flow of liquid coolant 622 may be directed through heat pipes 630 running under each of the electronic components of the electrocrushing drill assembly 600, such as power dissipating semiconductors. The heat pipes may form a single or multi-inlet and a single or multi-outlet network that reaches one, a plurality, or all the components of the BHA 502 to be cooled. Depending on the heat generated by the components of the electrocrushing drill assembly 600 and temperature rises in the heat-pipe network, the coolant may be in a liquid and a vapor state. Because the liquid coolant can be pumped downhole from the surface of the wellbore, an electrocrushing drilling system according to the present disclosure can handle very high temperatures, which may be a significant advantage in geothermal well-network drilling.

Figure 7:
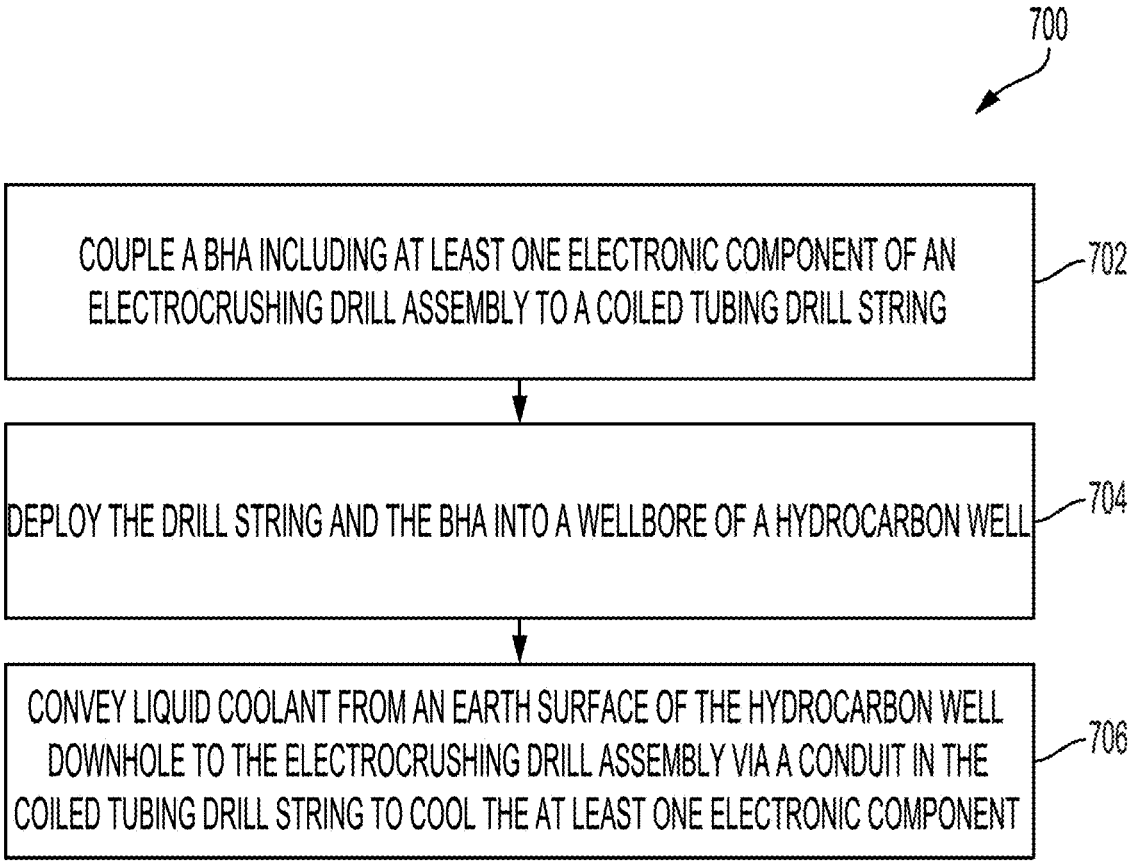
FIG. 7 is flowchart illustrating a method of cooling one or more components of an electrocrushing drilling assembly of an electrocrushing drilling apparatus according to one example of the present disclosure.

FIG. 7 is flowchart 700 illustrating a method of cooling one or more components of an electrocrushing drilling assembly according to one example of the present disclosure.

As indicated at block 702, a bottomhole assembly may be coupled to a downhole end of a coiled tubing drill string. The bottomhole assembly can include at least one electronic component of a downhole electrocrushing drill assembly of an electrocrushing drilling apparatus. For example, the bottomhole assembly can include one or more of an input filter, a boost charger, a pulsed power controller, a pulse transformer, a switch bank, a primary capacitor(s), or a secondary capacitor(s) of the electrocrushing drill assembly. The bottomhole assembly also includes an electrocrushing drill bit comprising a plurality of electrodes, and may also include one or more downhole coolant pumps in some implementations. Other components such as telemetry/steering modules or LWD/MWD tools may also be part of the bottomhole assembly.

As indicated at block 704, the coiled tubing drill string with the bottomhole assembly coupled thereto may then be deployed into a wellbore of a hydrocarbon well. The drill string can be deployed into the wellbore such that the electrodes of the electrocrushing drill assembly are in sufficiently close proximity to a bottom of the wellbore to fracture formation rock via high voltage electrical energy pulses emitted from the electrodes of the electrocrushing drill bit. The electrocrushing drilling apparatus may also include for this purpose, other components that are located at an earth surface of the hydrocarbon well. For example, the electrocrushing drilling apparatus can include a power supply (e.g., a high voltage DC power supply), a control and communications unit for controlling and directing the electrocrushing drilling operation, a drilling fluid pump, and a liquid coolant pump. A power cable can be provided to transmit electrical energy from the power supply downhole to the bottomhole assembly. A communications cable may be used to transmit commands or other information downhole to the electrocrushing drill assembly or other components of the bottomhole assembly. The power cable and the communications cable may be secured within or to an outside surface of the coiled tubing drill string.

As indicated at block 706, the liquid coolant pump located at the earth surface of the hydrocarbon well can be used to convey liquid coolant from a liquid coolant source downhole to the at least one electronic component of the electrocrushing drill assembly via a liquid coolant conduit located within the coiled tubing drill string. The liquid coolant can flow under pressure through one or more heat pipes of the at least one electronic component of the electrocrushing drill assembly and thermally absorb and remove heat from the at least one electronic component. In some examples, the liquid coolant may be a cryogenic liquid or chilled water.

In some examples, the aforementioned drilling fluid pump located at the earth surface of the hydrocarbon well can be used to convey drilling fluid from a drilling fluid source downhole to the electrocrushing drill assembly to facilitate the electrocrushing drilling operation. In at least some examples, the drilling fluid may be conveyed to the electrocrushing drill assembly via a drilling fluid conduit located within the coiled tubing drill string. In other examples, the coiled tubing itself may serve as the drilling fluid conduit.

In some aspects, a system, an electrocrushing drilling apparatus, and a method are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a system including a coiled tubing drill string that is deployable from an earth surface into a wellbore of a hydrocarbon well. A bottomhole assembly is coupled to a downhole end of the coiled tubing drill string and includes at least one electronic component of an electrocrushing drill assembly. A liquid coolant conduit is located within the coiled tubing drill string and a liquid coolant pump is located at the earth surface. The pump is in fluid communication with a liquid coolant source and is couplable to the liquid coolant conduit to convey liquid coolant from the liquid coolant source downhole to the at least one electronic component of the electrocrushing drill assembly.

Example 2 is the system of example 1, wherein the bottomhole assembly includes one or more additional components of the electrocrushing drill assembly. The one or more additional components can include an input filter, a boost charger, a pulsed power controller, a pulse transformer, a switch bank, a primary capacitor, a secondary capacitor, a downhole coolant pump, a plurality of electrodes, or any combination thereof.

Example 3 is the system of example 2, wherein the downhole coolant pump is usable in conjunction with the liquid coolant pump located at the earth surface to convey the liquid coolant from the liquid coolant source downhole to the at least one electronic component of the electrocrushing drill assembly.

Example 4 is the system of any of examples 1-3, wherein the liquid coolant is flowable under pressure through one or more heat pipes of the at least one electronic component of the electrocrushing drill assembly to thermally absorb and remove heat from the at least one electronic component.

Example 5 is the system of any of examples 1-4, further including a power cable secured within or to an outside surface of the coiled tubing drill string and couplable to a power supply located at the earth surface to provide electrical energy to the electrocrushing drill assembly.

Example 6 is the system of any of examples 1-5, further including a drilling fluid conduit located within the coiled tubing drill string and couplable to a drilling fluid pump located at the earth surface to provide drilling fluid to the electrocrushing drill assembly.

Example 7 is the system of any of examples 1-6, wherein the liquid coolant is a cryogenic liquid or chilled water.

Example 8 is an electrocrushing drilling apparatus including a bottomhole assembly that is positionable in a wellbore of a hydrocarbon well. The bottomhole assembly can include an electrocrushing drill assembly having an electrocrushing drill bit, and the electrocrushing drill assembly is positionable to advance the wellbore by fracturing rock within the wellbore via high voltage electrical energy pulses emitted from a plurality of electrodes of the electrocrushing drill bit. One or more fluid pathways pass through the electrocrushing drill assembly and are positionable to receive a flow of a drilling fluid and a flow of a liquid coolant via a coiled tubing drill string deployed from an earth surface into the wellbore of the hydrocarbon well.

Example 9 is the electrocrushing drilling apparatus of example 8, wherein the electrocrushing drill assembly includes one or more electronic components that may be an input filter, a boost charger, a pulsed power controller, a pulse transformer, a switch bank, a primary capacitor(s), a secondary capacitor(s), or any combination thereof.

Example 10 is the electrocrushing drilling apparatus of example 9, wherein the one or more fluid pathways are one or more heat pipes through the one or more electronic components and the liquid coolant is flowable under pressure through one or more heat pipes to thermally absorb and remove heat from the one or more electronic components.

Example 11 is the electrocrushing drilling apparatus of any of examples 8-10, wherein the electrocrushing drill assembly further includes one or more downhole liquid coolant pumps to assist with flowing the liquid coolant under pressure through the one or more fluid pathways passing through the one or more electronic components of the electrocrushing drill assembly, and the one or more downhole liquid coolant pumps are operable in conjunction with a liquid coolant pump located at an earth surface of the hydrocarbon well to flow the liquid coolant under pressure through the one or more fluid pathways passing through the one or more electronic components of the electrocrushing drill assembly.

Example 12 is the electrocrushing drilling apparatus of any of examples 8-11, further including one or more components located at the earth surface. The one or more components may include a power supply, a control/communications unit, a liquid coolant pump, a drilling fluid pump, a boost charge, a power pulse generator, or any combination thereof.

Example 13 is the electrocrushing drilling apparatus of example 12, wherein at least one of the one or more fluid pathways passing through the electrocrushing drill assembly is positionable in fluid communication with a liquid coolant conduit that is located within the coiled tubing drill string to convey liquid coolant from the liquid coolant pump to the electrocrushing drill assembly, and at least one of the one or more fluid pathways passing through the electrocrushing drill assembly is positionable in fluid communication with a drilling fluid conduit that is located within the coiled tubing drill string to convey drilling fluid from the drilling fluid pump to the electrocrushing drill assembly.

Example 14 is the electrocrushing drilling apparatus of any of examples 8-13, wherein the liquid coolant is a cryogenic liquid or chilled water.

Example 15 is a method that includes coupling a bottomhole assembly including at least one electronic component of a downhole portion of an electrocrushing drill assembly to a downhole end of a coiled tubing drill string, and deploying the coiled tubing drill string with the bottomhole assembly coupled thereto into a wellbore of a hydrocarbon well. The method also includes using a liquid coolant pump located at an earth surface of the hydrocarbon well to convey liquid coolant from a liquid coolant source downhole to the at least one electronic component of the electrocrushing drill assembly via a liquid coolant conduit located within the coiled tubing drill string.

Example 16 is the method of example 15, wherein the bottomhole assembly includes one or more additional components of the electrocrushing drill assembly. The one or more components may include an input filter, a boost charger, a pulsed power controller, a pulse transformer, a switch bank, a primary capacitor(s), a secondary capacitor(s), a downhole coolant pump, a plurality of electrodes, or any combination thereof.

Example 17 is the method of example 16, wherein the downhole coolant pump boosts the pressure and flow rate of the liquid coolant conveyed downhole by the liquid coolant pump located at the earth surface before directing the liquid coolant to the at least one electronic component of the electrocrushing drill assembly.

Example 18 is the method of any of examples 15-17, wherein the liquid coolant flows under pressure through one or more heat pipes of the at least one electronic component of the electrocrushing drill assembly and thermally absorbs and removes heat from the at least one electronic component.

Example 19 is the method of any of examples 15-18, further comprising controlling transmission of electrical energy from a power supply located at the surface of the hydrocarbon well downhole to the electrocrushing drill assembly by transmitting the electrical energy through a power cable that is secured within or to an outside surface of the coiled tubing drill string; and controlling conveyance of drilling fluid from a drilling fluid pump located at the surface of the hydrocarbon well downhole to the electrocrushing drill assembly by conveying the drilling fluid through a drilling fluid conduit located within the coiled tubing drill string.

Example 20 is the method of any of examples 15-19, wherein the liquid coolant is a cryogenic liquid or chilled water.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a drill string deployable from an earth surface into a wellbore of a hydrocarbon well;

a bottomhole assembly coupled to a downhole end of the drill string and including at least one electronic component of an electrocrushing drill assembly;

a liquid coolant conduit located within the drill string; and a liquid coolant pump located at the earth surface, the pump in fluid communication with a liquid coolant source and couplable to the liquid coolant conduit to convey liquid coolant from the liquid coolant source downhole to the at least one electronic component of the electrocrushing drill assembly.

2. The system of claim 1, wherein the bottomhole assembly includes one or more additional components of the electrocrushing drill assembly, the one or more additional components comprising an input filter, a boost charger, a pulsed power controller, a pulse transformer, a switch bank, a primary capacitor, a secondary capacitor, a downhole coolant pump, a plurality of electrodes, or any combination thereof.

3. The system of claim 2, wherein the downhole coolant pump is usable in conjunction with the liquid coolant pump located at the earth surface to convey the liquid coolant from the liquid coolant source downhole to the at least one electronic component of the electrocrushing drill assembly.

4. The system of claim 1, wherein the liquid coolant is flowable under pressure through one or more heat pipes of the at least one electronic component of the electrocrushing drill assembly to thermally absorb and remove heat from the at least one electronic component.

5. The system of claim 1, further comprising a power cable secured within or to an outside surface of the drill string and couplable to a power supply located at the earth surface to provide electrical energy to the electrocrushing drill assembly.

6. The system of claim 1, further comprising a drilling fluid conduit located within the drill string and couplable to a drilling fluid pump located at the earth surface to provide drilling fluid to the electrocrushing drill assembly.

7. The system of claim 1, wherein the liquid coolant is a cryogenic liquid or chilled water.

8. The system of claim 1, wherein:

the drill string is a modular coiled tubing drill string comprising at least two coiled tubing sections joined by a coupling assembly comprising:

an uphole portion coupled to a downhole end of an uphole section of the coiled tubing or a downhole end of a drill string component coupled to the downhole end of the uphole section of the coiled tubing, and a downhole portion coupled to an uphole end of a downhole section of the coiled tubing or an uphole end of a drill string component coupled to the uphole end of the downhole section of the coiled tubing; and each of the uphole portion and the downhole portion of the coupling assembly includes mating connectors that enable sections of the liquid coolant conduit, a drilling fluid conduit, and a power cable associated with the uphole section of the coiled tubing to be communicatively coupled to corresponding sections of the liquid coolant conduit, the drilling fluid conduit, and the power cable associated with the downhole section of the coiled tubing upon a coupling of the uphole portion of the coupling assembly to the downhole portion of the coupling assembly.

9. The system of claim 8, wherein:

the uphole portion of the coupling assembly is coupled to a downhole end of a drill string component coupled to the downhole end of the uphole section of the coiled tubing;

the downhole portion of the coupling assembly is coupled to the uphole end of a drill string component coupled to the uphole end of the downhole section of the coiled tubing; and the drill string component comprises at least one of:

a controllable valve via which a downhole flow of liquid coolant or drilling fluid is adjustable or stoppable, a controllable switch via which a downhole flow of electrical energy to the at least one electronic component of the electrocrushing drill assembly is disconnectable, or a sensor via which operations of one or more components of the bottomhole assembly, a telemetry module, a steering subsystems module, a logging while drilling tool, or a measuring while drilling tool are monitorable.

10. An electrocrushing drilling apparatus comprising:

one or more components comprising a power supply, a control and communications unit, a liquid coolant pump, a drilling fluid pump, a boost charger, a power pulse generator, or any combination thereof, located at an earth surface of a wellbore of a hydrocarbon well;

a bottomhole assembly positionable in the wellbore and comprising:

an electrocrushing drill assembly including an electrocrushing drill bit, the electrocrushing drill assembly positionable to advance the wellbore by fracturing rock within the wellbore via high voltage electrical energy pulses emitted from a plurality of electrodes of the electrocrushing drill bit; and a plurality of fluid pathways passing through the electrocrushing drill assembly, at least one of the plurality of fluid pathways positionable in fluid communication with a liquid coolant conduit that is located within the drill string to convey liquid coolant from the liquid coolant pump to the electrocrushing drill assembly, and at least one of the plurality of fluid pathways positionable in fluid communication with a drilling fluid conduit that is located within the drill string to convey drilling fluid from the drilling fluid pump to the electrocrushing drill assembly.

11. The electrocrushing drilling apparatus of claim 10, wherein the electrocrushing drill assembly includes one or more electronic components, the one or more electronic components comprising an input filter, a boost charger, a pulsed power controller, a pulse transformer, a switch bank, a primary capacitor(s), a secondary capacitor(s), or any combination thereof.

12. The electrocrushing drilling apparatus of claim 11, wherein the one or more fluid pathways are one or more heat pipes through the one or more electronic components and the liquid coolant is flowable under pressure through one or more heat pipes to thermally absorb and remove heat from the one or more electronic components.

13. The electrocrushing drilling apparatus of claim 11, wherein:

the one or more fluid pathways pass through the one or more electronic components and the electrocrushing drill assembly further includes one or more downhole liquid coolant pumps to assist with flowing the liquid coolant under pressure through the one or more fluid pathways; and the one or more downhole liquid coolant pumps are operable in conjunction with the liquid coolant pump located at the earth surface of the hydrocarbon well to flow the liquid coolant under pressure through the one or more fluid pathways.

14. The electrocrushing drilling apparatus of claim 10, wherein the liquid coolant is a cryogenic liquid or chilled water.

15. A method comprising:

coupling a bottomhole assembly to a downhole end of a drill string, the bottomhole assembly including at least one electronic component of a downhole portion of an electrocrushing drill assembly, the at least one electronic component comprising an input filter, a boost charger, a pulsed power controller, a pulse transformer, a switch bank, a primary capacitor, a secondary capacitor, a downhole coolant pump, a plurality of electrodes, or any combination thereof;

deploying the drill string with the bottomhole assembly coupled thereto into a wellbore of a hydrocarbon well; and using (i) a liquid coolant pump located at an earth surface of the hydrocarbon well to convey liquid coolant from a liquid coolant source downhole to the at least one electronic component of the electrocrushing drill assembly via a liquid coolant conduit located within the drill string, and (ii) a downhole coolant pump that boosts a pressure and a flow rate of the liquid coolant conveyed downhole by the liquid coolant pump located at the earth surface before directing the liquid coolant to the at least one electronic component of the electrocrushing drill assembly.

16. The method of claim 15, wherein the liquid coolant flows under pressure through one or more heat pipes of the at least one electronic component of the electrocrushing drill assembly and thermally absorbs and removes heat from the at least one electronic component.

17. The method of claim 15, further comprising:

controlling transmission of electrical energy from a power supply located at the surface of the hydrocarbon well downhole to the electrocrushing drill assembly by transmitting the electrical energy through a power cable that is secured within or to an outside surface of the drill string; and controlling conveyance of drilling fluid from a drilling fluid pump located at the surface of the hydrocarbon well downhole to the electrocrushing drill assembly by conveying the drilling fluid through a drilling fluid conduit located within the drill string.

18. The method of claim 15, wherein the liquid coolant is a cryogenic liquid or chilled water.

19. The method of claim 15, wherein:

the drill string is a modular coiled tubing drill string comprising at least two coiled tubing sections joined by a coupling assembly;

an uphole portion of the coupling assembly is coupled to a downhole end of an uphole section of the coiled tubing or a downhole end of a drill string component coupled to the downhole end of the uphole section of the coiled tubing;

a downhole portion of the coupling assembly is coupled to an uphole end of a downhole section of the coiled tubing or an uphole end of a drill string component coupled to the uphole end of the downhole section of the coiled tubing; and coupling of the uphole portion of the coupling assembly to the downhole portion of the coupling assembly causes sections of the liquid coolant conduit, a drilling fluid conduit, and a power cable associated with the uphole section of the coiled tubing to be communicatively coupled to corresponding sections of the liquid coolant conduit, the drilling fluid conduit, and the power cable associated with the downhole section of the coiled tubing.

20. The method of claim 19, wherein:

the uphole portion of the coupling assembly is coupled to a downhole end of a drill string component coupled to the downhole end of the uphole section of the coiled tubing;

the downhole portion of the coupling assembly is coupled to the uphole end of a drill string component coupled to the uphole end of the downhole section of the coiled tubing; and the drill string component comprises at least one of:

a controllable valve that selectively adjusts or stops a downhole flow of liquid coolant or drilling fluid, a controllable switch that selectively disconnects a downhole flow of electrical energy to the at least one electronic component of the electrocrushing drill assembly, or a sensor that monitors operations of one or more components of the bottomhole assembly, a telemetry module, a steering subsystems module, a logging while drilling tool, or a measuring while drilling tool.

* * * * *